US005730347A

United States Patent [19]

Finot

[11] Patent Number: 5,730,347

[45] Date of Patent: Mar. 24, 1998

[54] RUCKSACK

[75] Inventor: André Finot, Mureils, France

[73] Assignee: La Fuma SA, France

[21] Appl. No.: 802,885

[22] Filed: Feb. 19, 1997

[30] Foreign Application Priority Data

Feb. 20, 1996 [FR] France ..... 96 02293

[51] Int. Cl.[6] ..... A45F 3/08

[52] U.S. Cl. ..... 224/631; 224/628; 224/632; 224/634; 224/642; 224/644

[58] Field of Search ..... 224/153, 628, 224/631, 632, 633, 634, 635, 637, 642, 644, 259–264, 901.2, 901.8, 210, 211, 907

[56] References Cited

U.S. PATENT DOCUMENTS 5,005,744 4/1991 Gleason ..... 224/211

FOREIGN PATENT DOCUMENTS 0209381 1/1987 European Pat. Off. .
2637785 4/1990 France .
8716869 3/1988 Germany .
3844675 6/1990 Germany ..... 224/211
678796 11/1991 Switzerland .
2130481 6/1984 United Kingdom .

*Primary Examiner*—Henry J. Recla
*Assistant Examiner*—Timothy L. Maust
*Attorney, Agent, or Firm*—Wall Marjama & Bilinski

[57] ABSTRACT

A rucksack includes a bag portion, a back portion secured to the bag portion, and a reinforcing frame. The frame has an inverted U-shape including a pair of depending branch portions and a connecting portion secured to an outer face of the back portion. The rucksack also includes a linking piece formed from a pair of curved plates secured at respective lateral ends and defining an open cavity sized for allowing passage of the extending branch portions therethrough. A pair of shoulder straps extends from the upper end of the linking piece. According to the invention, the outer face of the back portion includes a first pair of coupling strips for contacting a corresponding second pair of coupling strips on the linking piece, allowing releasable attachment of the linking piece to the back portion of the rucksack and allowing simultaneous repositioning of the shoulder straps of the rucksack, depending on the morphology of a wearer's back.

5 Claims, 5 Drawing Sheets

RUCKSACK

FIELD OF THE INVENTION

The invention relates to an improved rucksack, more precisely to a rucksack equipped with a device allowing adjustment of the height of the shoulder straps. Rucksacks of this type make it possible to transport loads either in a closed container (climbing or camping rucksack), or in an at least partially open container, for transporting loads, for example, such as transporting young children in rucksacks which are commonly known as "child carriers", or even carrying racks.

BACKGROUND OF THE INVENTION

As is known, a rucksack or backpack comprises, an actual bag section for accommodating the load, and a back section which is generally thermoformed and reinforced by a frame. Alternately, a carrying harness is secured to this back section therefore consisting essentially of two shoulder straps and a waist strap.

Many rucksacks have two shoulder straps which can be adjusted in terms of length but not in terms of height, the anchoring points for the shoulder straps being positioned symmetrically at the top and the bottom of the back section. A system of this type does not take account of the variation in morphology of the back of different wearers (see FIG. 1).

Given this problem, it appeared necessary to be able to adjust the height of the shoulder straps.

One solution consists in providing, on the top of the back section, parallel sewn loops through which the top of the shoulder strap is threaded at the height chosen by the wearer. This arrangement is unsatisfactory since the shoulder strap adjusted in this way, with a constant length, turns out to be too long for short people and too short for tall people. Moreover, the adjustment is inaccurate (see FIG. 2).

In document FR-A-2,637,785, a described rucksack is equipped with two shoulder straps, each connected to a stirrup piece for interacting with the lateral edges of two straps sewn onto the top of the back section. In addition to the discomfort created by the presence of the two stirrup pieces in the back, this type of system does not allow the wearer to adjust the height of the shoulder straps simultaneously, which results in the rucksack's load becoming unbalanced. Moreover, the stirrup pieces are likely to open when subjected to jolts and vibrations during carrying.

The problem was thus to define a system for adjusting the shoulder straps which was accurate, simultaneously applicable to both shoulder straps and adaptable as a function of the morphology of the wearer's back.

SUMMARY OF THE INVENTION

The invention relates to a system for adjusting the shoulder straps of a rucksack which combines both respect for the comfort of the wearer and for the morphology of the latter's back.

Therefore the rucksack according to a preferred aspect of the present invention comprises:

- a bag section;
- a back section secured to said bag section;
- a frame having an inverted substantially U-shape and defined by a pair of branch portions and a connecting portion connecting said branch portions, said frame being secured to said back section for reinforcement therewith; and

- a linking piece having a pair of depending shoulder straps, wherein said back section includes a visible outer face having a first pair of secured coupling straps arranged oppositely from said branch portions of said secured frame, said linking piece including a second pair of coupling strips arranged opposite the first pair of coupling strips, said pairs of coupling strips having means for releasable attachment with each other to allow selective positioning of said shoulder straps along said back section of said rucksack, depending on the morphology of a wearer's back.

In other words, the back section of the rucksack has two parallel male coupling strips, sewn at the level of the two branches of the rigid frame, intended to interact with two female coupling strips arranged on a linking piece connected to the end of two shoulder straps, the linking piece being movable along the branches of the frame.

To adjust the height of the two shoulder straps simultaneously, it suffices to detach the linking piece from the back section of the rucksack and to slide it along the frames as far as the desired position.

To permit accurate adjustment, the coupling strips are sewn continuously to the back section of the rucksack. In this way, the wearer is able to vary the height of the linking piece and consequently that of the shoulder straps as he wishes and in an accurate manner.

In other words, the height of the linking piece will be adjusted as a function of the wearer's height. The shorter the wearer, the further away from the upper end of the frame the linking piece will be positioned. Conversely, the taller the wearer, the closer to the upper end of the said frame the linking piece will be positioned.

Given that they are fastened symmetrically to the linking piece, the two shoulder straps are always located at the same height regardless of the position of the linking piece. This characteristic makes it possible not to unbalance the distribution of the load.

Advantageously, the coupling strips are of the "pile/hook contact closure" type.

According to a further characteristic of the invention, the linking piece is formed from two rigid plates connected via their lateral end in order to enclose the two rigid branches. These two plates may be sewn, or even injected as a single piece.

In other words, the linking piece is shaped so that it is able to slide along the curved branches of the frame.

In order for the coupling strips arranged both on the linking piece and on the back section of the rucksack to be able to interact exactly without needing lateral adjustment, the two plates have a width which is slightly greater than the gap separating the two branches of the frame. The lateral ends of the two plates are sewn to each other so as to enclose the two branches of the frame while still allowing the linking piece to slide along them.

Advantageously, the outer plate of the linking piece includes a compressible comfort element intended to come into contact with the wearer's back, the upper end of the shoulder straps being connected, at the level of the branches, to the top of this compressible piece.

The presence of a comfort element arranged on the outer plate of the linking piece enables shocks to, particularly jolting of, the wearer's back to be absorbed. Moreover, this piece makes it possible to prevent painful contact between the wearer's back and the branches of the frame.

As already stated, the shoulder straps are fastened by their upper end to the top of this compressible piece opposite each of the two branches of the frame.

Advantageously, the outer face of each shoulder strap has an adjustable strap connected to the top of the back section.

This strap makes it possible to hold the top of the rucksack flat against the wearer's back and thus enables the load to be better distributed.

The way in which the invention may be implemented and the advantages ensuing therefrom will become more apparent from the following illustrative embodiment, which is based on the appended figures.

DETAILED DESCRIPTION OF THE INVENTION

The invention relates to a rucksack equipped with an adjustable shoulder-strap system capable of respecting the morphology of the wearer's back and the wearer's comfort.

Figure 2:
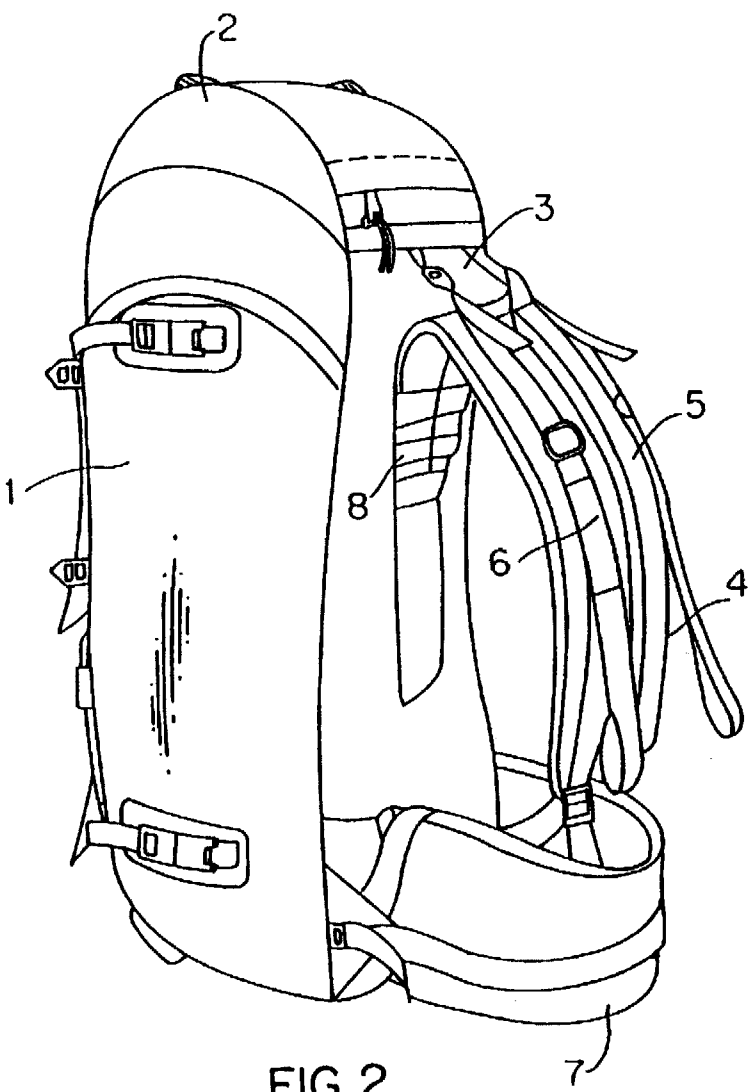
FIG. 2 is a diagrammatic perspective rear view of a prior art rucksack.

FIG. 2 shows a rucksack as is known from the prior art.

Figure 1:
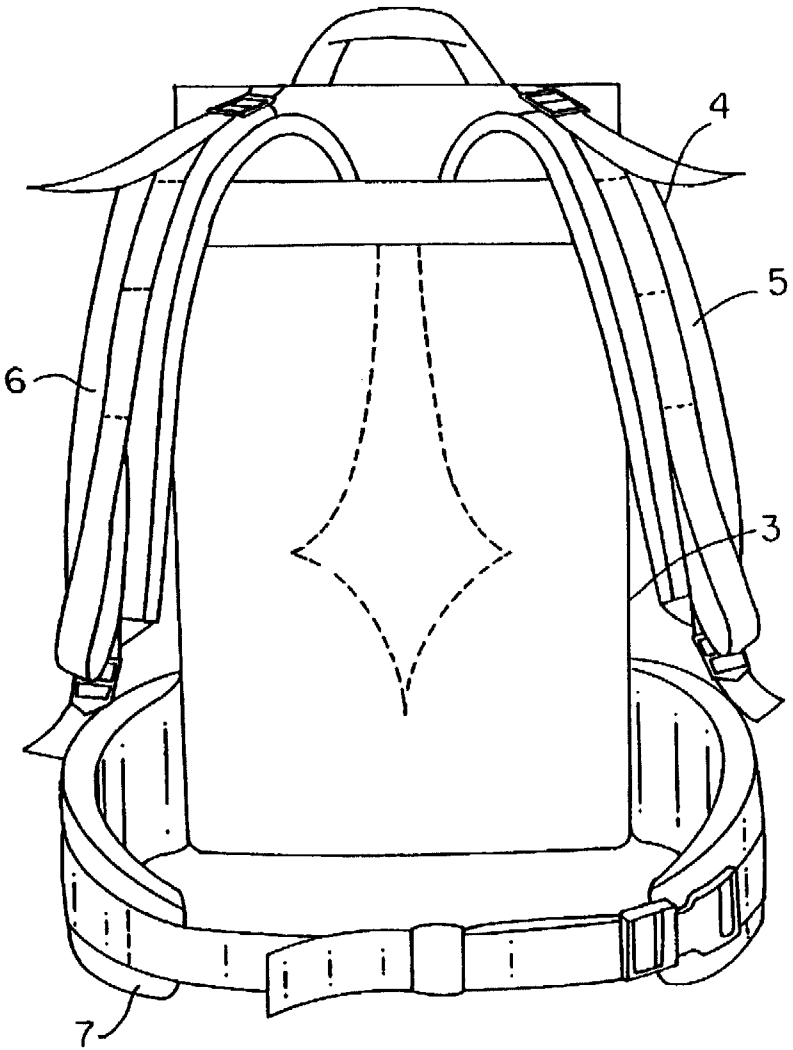
FIG. 1 shows the rear face of a prior art rucksack.

This rucksack, denoted by the reference (1), is equipped with an actual bag section (2) for accommodating the load and with a back section (3) which is placed against this bag section and is usually thermoformed. The back section (3) is equipped with a carrying harness (4) comprising two shoulder straps (5, 6) and a waist strap (7). Parallel loops (8) are sewn to the top of the back section, thus allowing the shoulder straps (5, 6) to be inserted in one or more loops (8) in order to adjust the height of the said shoulder straps (5, 6). The waist strap (7) shown in FIGS. 1 and 2 is sewn to the bottom of the back section (3) of the rucksack.

Figure 3:
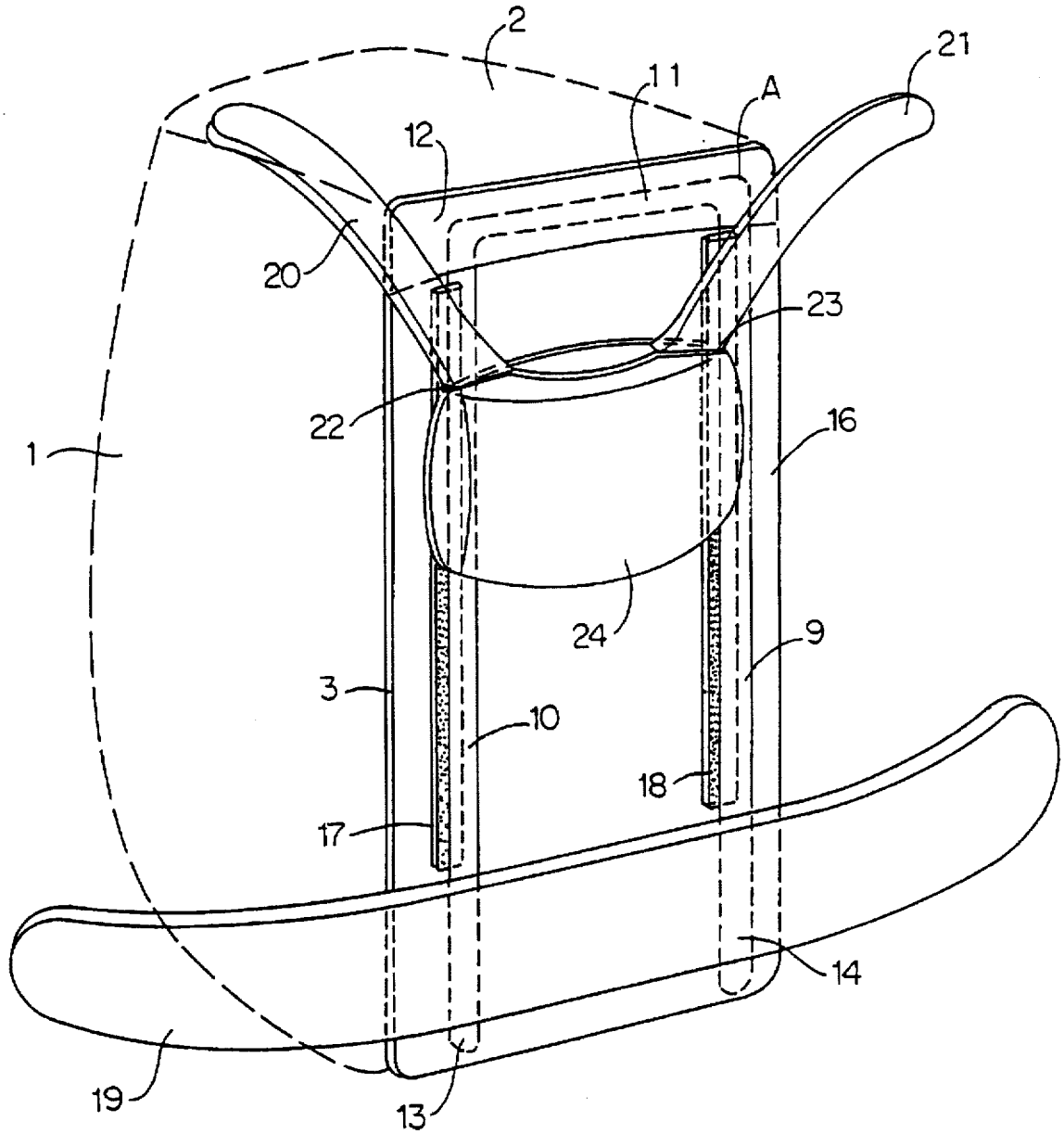
FIG. 3 is a diagrammatic perspective rear view of a rucksack according to a preferred embodiment of the present invention.

The rucksack (1) according to the invention, shown from the rear in FIG. 3, includes a back section (3) secured to the bag section (2). Moreover, this back section (3) is reinforced by an inverted-U-shaped frame (A) with two rigid branches (9, 10) connected by a connection portion (11). This rigid frame (A) is fastened to the top of the back section (3) by the connection portion (11) of the two branches (9, 10). More precisely, this connection portion (11) is inserted into a pocket (12) provided for this purpose on the top of the back section (3). The frame (A) is fastened to the bottom of the back section (3) via the end (13, 14) of the branches (9, 10).

According to an essential characteristic of the invention, the back section (3) includes on its visible outer face (16) two coupling strips (17, 18) arranged opposite the two branches (9, 10) of the frame (A). These two coupling strips (17, 18) are sewn to the visible outer face (16) of the back section (3) over a portion equal to the height of the branches (9, 10) of the frame (A).

Figure 4:
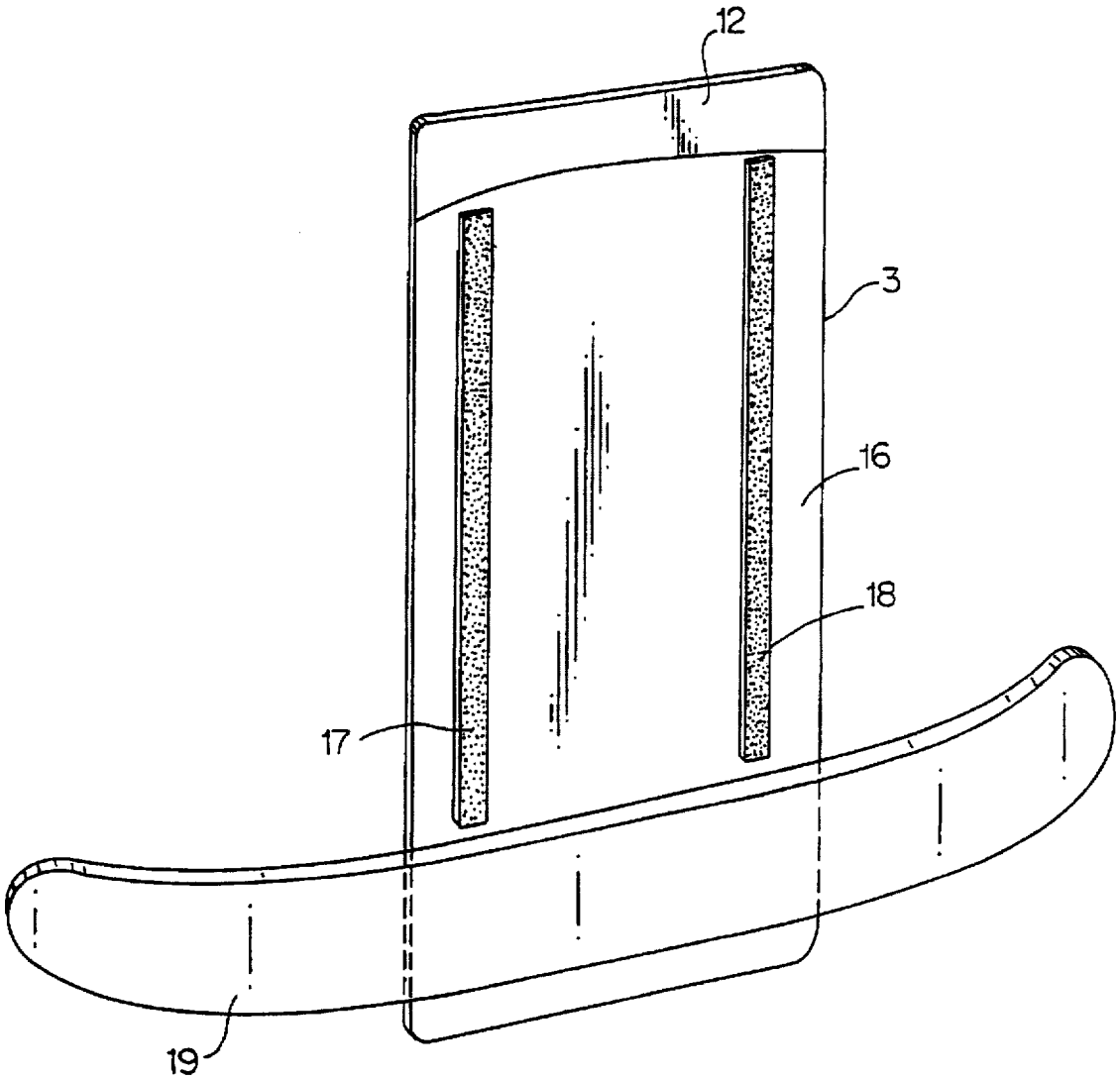
FIG. 4 is a detailed view of the back section and of the waist strap of the rucksack of FIG. 3.
Figure 5:
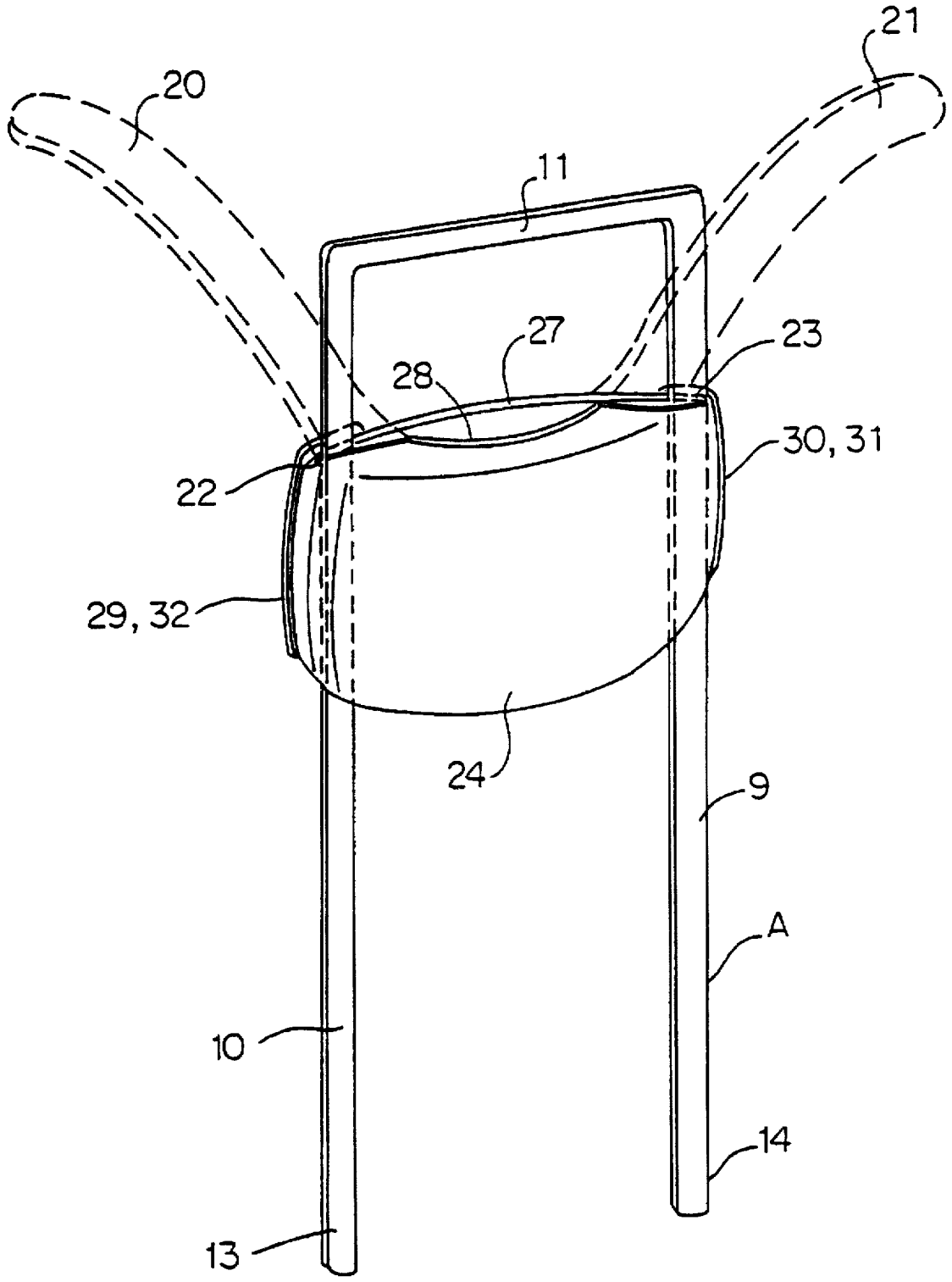
FIG. 5 is a detailed view of the frame and of the linking piece according to the invention.

Advantageously, as is shown in FIG. 4, the coupling strips (17, 18) are sewn down over two thirds of the height of the back section (3).

Furthermore, the rucksack according to the invention includes a carrying harness equipped with a waist strap (19) and two shoulder straps (20, 21) connected via their upper end (22, 23) to a linking piece (24).

Figure 6:
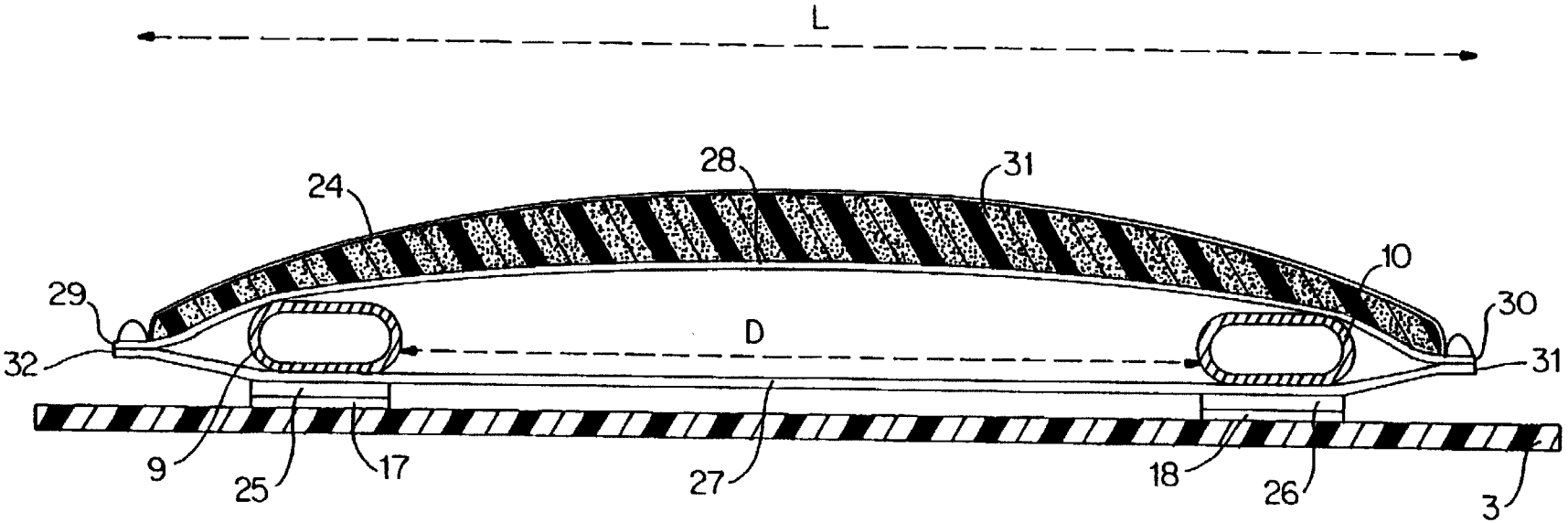
FIG. 6 is a longitudinal of the rucksack of FIGS. 3 and 4; and through the linking piece of FIG. 5.

This linking piece (24) is intended to slide along the curved branches (9, 10) of the frame (A). This linking piece (24), as shown in FIG. 6, is equipped with two coupling strips (25, 26) arranged opposite the two coupling strips (17, 18) sewn to the back section (3) of the bag section (2), in order to be able to interact. In other words, the position of these coupling strips opposite each other makes it possible to fasten the linking piece in a specific position.

Advantageously, these coupling strips are of the "pile/hook contact closure" type.

As shown in FIG. 6, the linking piece (24) is formed from two rigid plates (27, 28) which are connected to each other via their lateral end (29, 30, 31, 32) so as to enclose the two rigid branches (9, 10) of the frame (A). The width (L) of the two rigid plates (27, 28) forming the linking piece (24) is slightly greater than the distance (D) separating the two branches (9, 10) of the frame (A) so that said branches can be enclosed.

Each of the lateral ends (29, 30) and (31, 32) of the rigid plates (27, 28) are sewn to one another. Stitching is carried out at a distance from the outer edge of the branches (9, 10) which is sufficient to allow the linking piece to slide smoothly along the frames.

In practice, stitching is carried out one centimeter from the outer edges of the frame (A).

According to a further characteristic of the invention, the outer plate (24) includes a compressible comfort element (31) intended to come into contact with the wearer's back. The top of this compressible element (31) is connected to the upper end (22, 23) of the shoulder straps (20, 21). The shoulder straps (20, 21) are thus sewn down at the level of the branches (9, 10) of the frame (A).

According to one embodiment (not shown), the outer face of each shoulder strap (20, 21) has an adjustable strap connected to the top of the back section (3).

Advantageously, the end of the strap is fastened midway between the two ends of the shoulder strap.

In other words, the invention allows easy adjustment of the height of the shoulder straps. Moreover, this adjustment is carried out simultaneously on both shoulder straps and therefore does not give rise to any imbalance in the load. This system is therefore adapted to the morphology of any user's back. Carrying comfort is thereby further improved.

In this way, the invention may be advantageously applied to climbing or camping rucksacks as well as, in a more general manner, to any carrying device such as, in particular, child carriers or carrying racks.

I claim:

1. A rucksack comprising:

a bag section;

a back section secured to said bag section;

a frame having a inverted substantially U-shape and defined by a pair of branch portions and a connecting portion connecting said branch portions, said frame being secured to said back section for reinforcement therewith; and a linking piece having a pair of depending shoulder straps, wherein said back section includes a visible outer face having a first pair of secured coupling strips arranged oppositely from said branch portions of said secured frame, said linking piece including a second pair of coupling strips arranged opposite the first pair of coupling strips, said pairs of coupling strips having means for releasable attachment with each other to allow selective positioning of said shoulder straps along said back section of said rucksack, depending on the morphology of a wearer's back.

2. A rucksack as recited in claim 1, wherein said first and second pairs of coupling strips are of the pile/hook contact closure type for allowing releasable attachment with each other.

3. A rucksack as recited in claim 1, wherein said linking piece is formed from a pair of curved rigid plates, said plates being attached at opposing lateral ends and defining a cavity sized for allowing said branch portions to pass therethrough.

4. A rucksack as recited in claim 1, wherein said linking piece includes a compressible comfort element for contacting a wearer's back.

5. A rucksack as recited in claim 1, wherein an outer portion of each shoulder strap includes an adjustable strap connected to a top of said back section.

* * * * *